US008371068B1

(12) United States Patent
Kunz

(10) Patent No.: US 8,371,068 B1
(45) Date of Patent: Feb. 12, 2013

(54) SYSTEM AND METHOD FOR IMPROVING THE WEAR LIFE OF A BRAKE SHOE IN THE COUNTERBALANCE SYSTEM OF A TILT-IN WINDOW

(76) Inventor: John R. Kunz, Douglassville, PA (US)

( * ) Notice: Subject to any disclaimer, the term of this patent is extended or adjusted under 35 U.S.C. 154(b) by 360 days.

(21) Appl. No.: 12/717,934

(22) Filed: Mar. 4, 2010

Related U.S. Application Data

(63) Continuation-in-part of application No. 11/072,122, filed on Mar. 7, 2005, now Pat. No. 7,966,770.

(51) Int. Cl.
*E05D 15/22* (2006.01)
*E05D 15/24* (2006.01)

(52) U.S. Cl. ..... 49/181; 49/176; 16/193; 16/199; 16/200

(58) Field of Classification Search ..... 49/506, 49/176, 181, 445, 447; 16/193, 197, 199, 16/200, 400, 401
See application file for complete search history.

(56) References Cited

U.S. PATENT DOCUMENTS

| | | | | | |
|---|---|---|---|---|---|
| 1,097,524 | A | * | 5/1914 | Brownjohn | 49/150 |
| 3,184,784 | A | * | 5/1965 | Peters | 16/260 |
| 3,429,071 | A | * | 2/1969 | Phillips | 49/181 |
| 3,724,131 | A | * | 4/1973 | Schnormeier | 49/181 |
| 4,718,194 | A | * | 1/1988 | FitzGibbon et al. | 49/181 |
| 5,027,557 | A | * | 7/1991 | May | 49/181 |
| 5,099,963 | A | * | 3/1992 | Alchin | 188/136 |
| 5,353,548 | A | | 10/1994 | Westfall | |
| 5,463,793 | A | | 11/1995 | Westfall | |
| 5,661,927 | A | * | 9/1997 | Polowinczak et al. | 49/447 |
| 6,041,475 | A | * | 3/2000 | Nidelkoff | 16/193 |
| 6,058,653 | A | * | 5/2000 | Slocomb et al. | 49/181 |
| 6,151,832 | A | * | 11/2000 | Opielski et al. | 49/181 |
| 6,378,169 | B1 | | 4/2002 | Batten et al. | |
| 6,658,794 | B1 | * | 12/2003 | Hansel et al. | 49/181 |
| 6,763,550 | B2 | * | 7/2004 | Regnier | 16/193 |
| 6,886,295 | B2 | * | 5/2005 | Annes et al. | 49/181 |
| 7,194,839 | B2 | * | 3/2007 | O'Donnell et al. | 49/181 |
| 7,966,770 | B1 | * | 6/2011 | Kunz | 49/181 |
| 2003/0145523 | A1 | * | 8/2003 | Annes et al. | 49/181 |
| 2004/0206002 | A1 | * | 10/2004 | Kunz et al. | 49/181 |
| 2005/0160676 | A1 | * | 7/2005 | Pettit | 49/447 |
| 2005/0183340 | A1 | * | 8/2005 | O'Donnell et al. | 49/181 |
| 2005/0188620 | A1 | * | 9/2005 | Malek et al. | 49/181 |
| 2006/0230682 | A1 | * | 10/2006 | Ifko | 49/181 |
| 2007/0151157 | A1 | * | 7/2007 | O'Donnell et al. | 49/181 |
| 2007/0220706 | A1 | * | 9/2007 | Wellman et al. | 16/197 |
| 2008/0178424 | A1 | * | 7/2008 | Tuller | 16/193 |
| 2009/0064589 | A1 | * | 3/2009 | Tyler | 49/181 |

* cited by examiner

*Primary Examiner* — Katherine Mitchell
*Assistant Examiner* — Justin Rephann
(74) *Attorney, Agent, or Firm* — LaMorte & Associates, P.C.

(57) ABSTRACT

A counterbalance system for a tilt-in window and its method of operation. Posts are provided on the sides of a tilt-in window sash that rotate when the sash is tilted. A brake structure is attached to each post. Each brake structure has a first contoured surface that rotates with the post when said sash is tilted. A second contoured surface is provided within the window track. The second contoured surface moves up and down in the track with the post but does not rotate with the post when the sash is tilted. When the window sash is tilted for cleaning, the first contoured surface moves against the second contoured surface within the window track. A cam action occurs that moves the first contoured surface away from the second contoured surface. This causes the brake structure to be biased against the track and lock in a fixed position within the track.

12 Claims, 7 Drawing Sheets

SYSTEM AND METHOD FOR IMPROVING THE WEAR LIFE OF A BRAKE SHOE IN THE COUNTERBALANCE SYSTEM OF A TILT-IN WINDOW

RELATED APPLICATIONS

This application is a continuation-in-part of U.S. patent application Ser. No. 11/072,122, entitled ROUNDED SHOE AND POSITION BRAKE ASSEMBLY FOR THE COUNTERBALANCE SYSTEM OF A TILT-IN WINDOW, filed Mar. 7, 2005 now U.S. Pat. No. 7,966,770.

BACKGROUND OF THE INVENTION

1. Field of the Invention

In general, the present invention relates to counterbalance systems for windows that prevent open window sashes from moving under the force of their own weight. More particularly, the present invention system relates to the brake shoe component of the counterbalance systems for tilt-in windows.

2. Description of the Prior Art

There are many types and styles of windows. One of the most common types of window is the double-hung window. Double-hung windows are the window of choice for most home construction. A double-hung window consists of an upper window sash and a lower window sash. Either the upper window sash or the lower window sash can be selectively opened and closed by a person sliding the sash up and down within the window frame.

A popular variation of the double-hung window is the tilt-in double-hung window. Tilt-in double-hung windows have sashes that can be selectively moved up and down. Additionally, the sashes can be selectively tilted into the home so that the exterior of the sashes can be cleaned from within the home.

The sash of a double-hung window has a weight that depends upon the materials used to make the window sash and the size of the window sash. Since the sashes of a double-hung window are free to move up and down within the frame of a window, some counterbalancing system must be used to prevent the window sashes from always moving to the bottom of the window frame under the force of their own weight.

For many years counterbalance weights were hung next to the window frame in weight wells. The weights were attached to the window sash using a string or chain that passed over a pulley at the top of the window frame. The weights counterbalanced the weight of the window sashes. As such, when the sashes were moved in the window frame, they had a neutral weight and friction would hold them in place.

The use of weight wells, however, prevents insulation from being packed tightly around a window frame. Furthermore, the use of counterbalance weights on chains or strings cannot be adapted well to tilt-in double-hung windows. Accordingly, as tilt-in windows were being developed, alternative counterbalance systems were developed that were contained within the confines of the window frame and did not interfere with the tilt action of the tilt-in windows.

Modern tilt-in double-hung windows are primarily manufactured in one of two ways. There are vinyl frame windows and wooden frame windows. In the window manufacturing industry, different types of counterbalance systems are traditionally used for vinyl frame windows and for wooden frame windows. The present invention is mainly concerned with the structure of vinyl frame windows. As such, the prior art concerning vinyl frame windows is herein addressed.

Vinyl frame, tilt-in, double-hung windows are typically manufactured with guide tracks along the inside of the window frame. Brake shoe assemblies, commonly known as "shoes" in the window industry, are placed in the guide tracks and ride up and down within the guide tracks. Each sash of the window has two tilt pins or tilt posts that extend into the shoes and cause the shoes to ride up and down in the guide tracks as the window sashes are opened or closed.

In prior art counterbalance systems, the shoes serve more than one purpose. The shoes contain a brake mechanism that is activated by the tilt post of the window sash when the window sash is tilted inwardly away from the window frame. The shoe therefore locks the tilt post in place and prevents the base of the sash from moving up or down in the window frame once the sash is tilted open. Second, the shoes engage curl springs. Curl springs are constant force coil springs that supply the counterbalance force to the weight of the window sash.

Single curl springs are used on windows with light sashes. Multiple curl springs are used on windows with heavy sashes. The curl springs provide the counterbalance force to the window sashes needed to maintain the sashes in place. The counterbalance force of the curl springs is transferred to the window sashes through the structure of the shoes and the tilt posts that extend from the window sash into the shoes.

Prior art shoes that contain braking mechanisms and engage counterbalance curl springs are exemplified by U.S. Pat. No. 6,378,169 to Batten, entitled Mounting Arrangement For Constant Force Spring Balance; U.S. Pat. No. 5,463,793 to Westfall, entitled Sash Shoe System For Curl Spring Window Balance; and U.S. Pat. No. 5,353,548 to Westfall, entitled Curl Spring Shoe Based Window Balance System.

Prior art shoes for curl spring counterbalance systems are typically complex assemblies. The shoes must contain a brake mechanism strong enough to lock a sash in place. Furthermore, the shoes must engage at least one strong curl spring. In modern tilt-in window construction, curl springs are made from flat bands of spring steel that are rolled into tight coils. The ends of the curl springs typically attach to the brake shoes at an off-center point. As a result, although the curl springs bias the brake shoes upwardly in the window frame track, the curl springs also apply a torque force to the brake shoes. The torque force tends to cock or rotate the brake shoe within the window track. The shoe binds in the guide track and the window becomes so difficult to open and close that it cannot be considered functional. This cocked orientation also causes the brake shoe to wear against the window track in an uneven manner. Over time, it often becomes more difficult for the oddly worn shoes to move up and down.

A need therefore exists in the field of vinyl, tilt-in, double-hung windows, for a counterbalance system that eliminates the uneven wear of brake shoes caused by the spring torque. A need also exists in the field of vinyl, tilt-in double-hung windows for a counterbalance system that provides inexpensive, easily installed brake shoes that are highly reliable. These needs are met by the present invention as described and claimed below.

SUMMARY OF THE INVENTION

The present invention is a brake shoe assembly used within a counterbalance system for a tilt-in window. The brake shoe assemblies ride in guide tracks within the frame of the window along the sides of the window sashes. Tilt posts extend from the sashes into the brake shoe assemblies, wherein the brake shoe assemblies guide the movement of the tilt posts up and down in the guide tracks.

The brake shoe assemblies have housings with opposing face sections and rear sections that are disposed within a periphery of a first curved side edge, a second curved side edge and a bottom edge. The brake shoe attaches to a coil spring that cocks the brake shoe in the guide track. The first curved side edge and the second curved side edge contact the guide track at a tangent when the brake housing is cocked. The tangential contact minimizes wear and prevents the brake shoe housing from binding.

The brake shoe assemblies also contain an internal brake mechanism that acts to spread the face section of the brake shoe housing from the rear section along at least one edge when the sash of the window is tilted. As the brake shoe housing is spread apart, it interferes with the guide track and becomes locked in place until the window sash is tilted upright to its operational position.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE INVENTION

Figure 1:
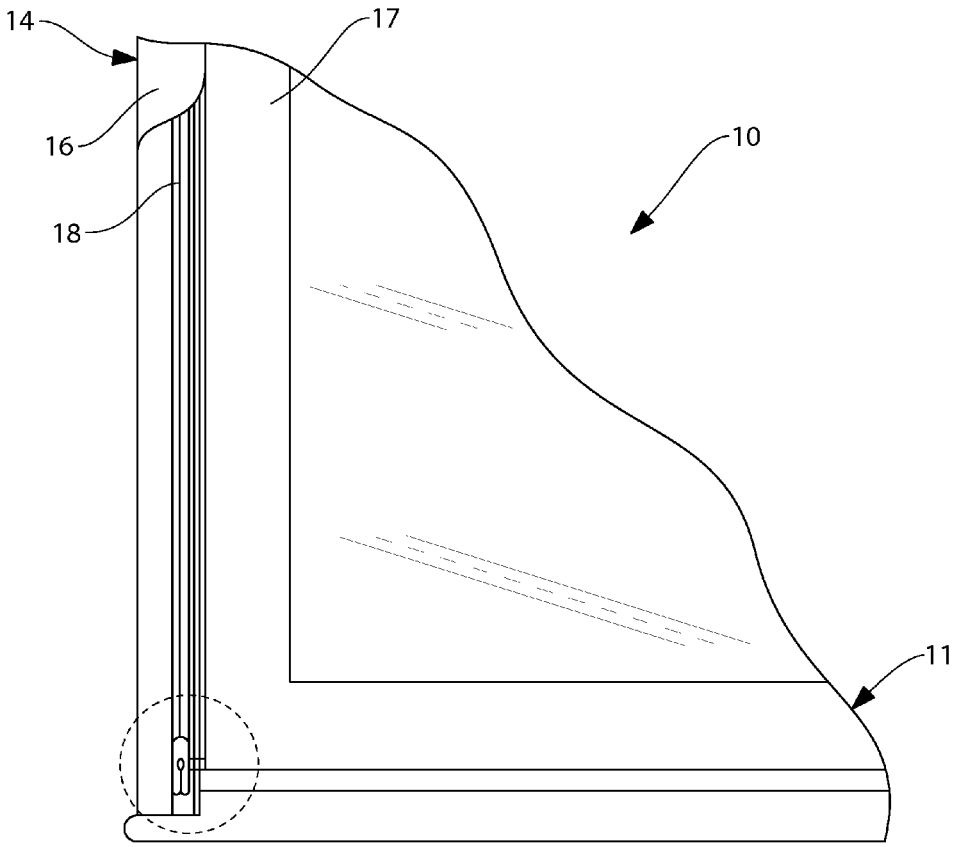
FIG. 1 is a partially fragmented view of a tilt-in window assembly containing a counterbalance system in accordance with the present invention.

Referring to FIG. 1, there is shown an exemplary embodiment of a vinyl, tilt-in, double-hung window assembly 10. The window assembly 10 has two sashes 11, which include an upper sash and a lower sash. Each of the sashes 11 has two side elements 17. The sashes 11 are contained within a window frame 14. The window frame 14 has two vertical sides 16 that extend along the side elements 17 of both sashes 11. Within each of the vertical sides 16 of the window frame 14 is formed a guide track 18.

Figure 2:
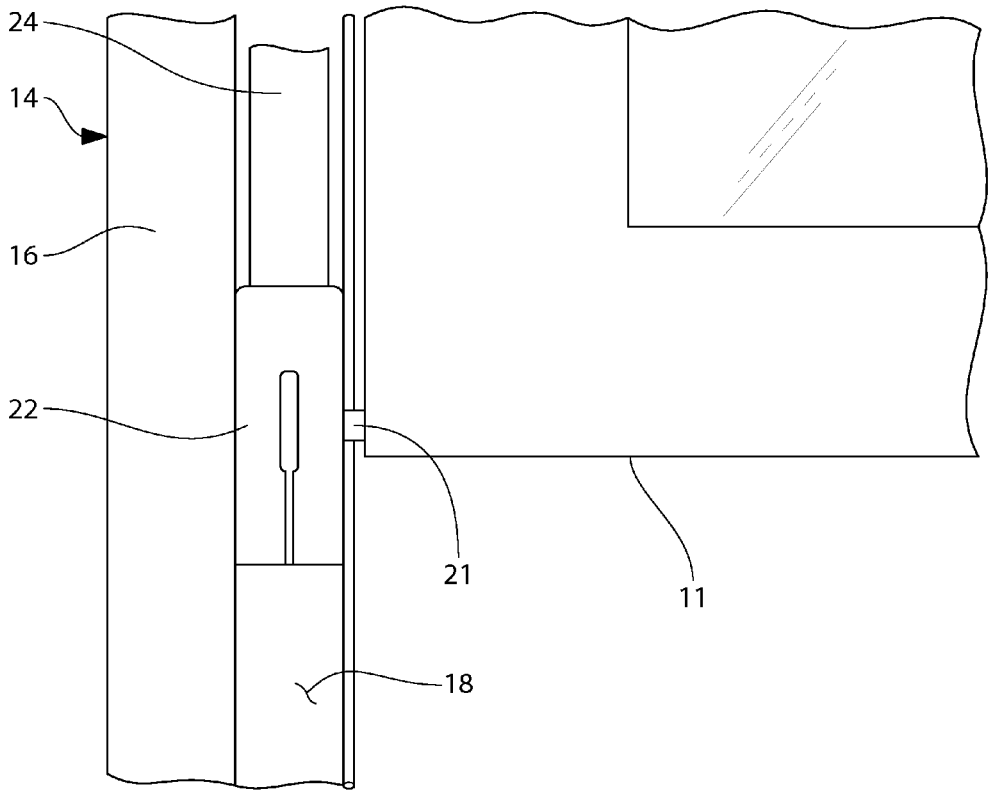
FIG. 2 is an enlarged view of the encircled area of the brake shoe assembly contained within FIG. 1.

Referring to FIG. 2, it can be seen that the sash 11 has a tilt post 21 that extends out away from the side of the sash 11 and into the guide tracks 18 in the vertical sides 16 of the window frame 14. As is later explained in greater detail, a brake shoe assembly 22 is provided that attaches to the tilt post 21. The brake shoe assembly 22 serves two purposes. First, the brake shoe assembly 22 serves as a brake mechanism that locks the bottom of a sash 11 in place within the guide track 18 when a sash 11 is tilted inwardly. Second, the brake shoe assembly 22 serves as a point of attachment for a curl spring 24.

The curl spring 24 rotates and unwinds from a hub that is anchored high in the guide track 18. The free end of the curl spring 24 is affixed to the brake shoe assembly 22. Accordingly, the curl spring 24 applies an upward counterbalance force to each sash 11 that counteracts the weight of each sash 11.

Figure 3:
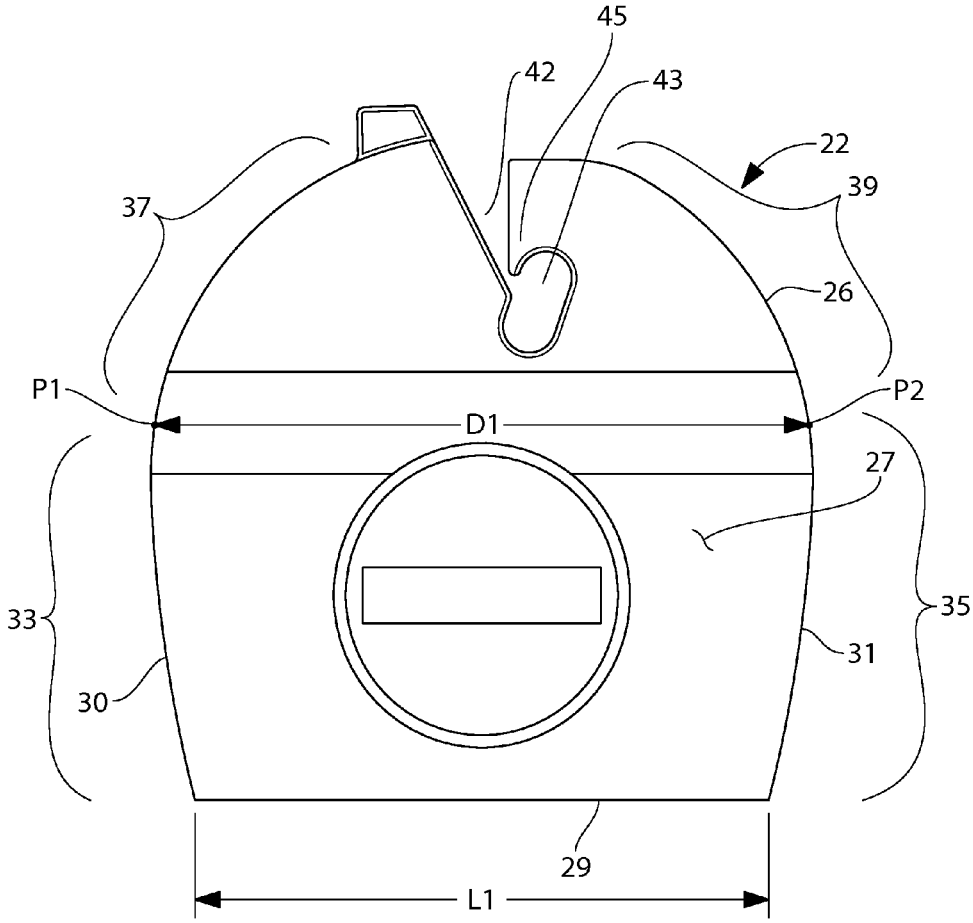
FIG. 3 is a side view of an exemplary embodiment of a brake shoe assembly.

Referring to FIG. 3, it can be seen that the brake shoe assembly 22 has a uniquely shaped housing 26. The brake shoe housing 26 has a face surface 27 and a opposite rear surface (not shown). The housing 26 has a straight bottom edge 29. The bottom edge 29 has a length L1. Two curved side edges 30, 31 extend upwardly from opposite sides of the bottom edge 29. The first curved side edge 30 and the second curved side edge curve toward one another, thereby providing the housing 26 of the brake shoe 22 with curved sides and a curved top.

The first and second curved side edges 30, 31 of the brake shoe housing 26 have complex curvatures. Both the first curved side edge 30 and the second curved side edge 31 have upper sections and lower sections of dissimilar curvature. The lower section 33 of the first curved side edge 30 and the lower section 35 of the second curved side edge 31 both share the same mild radius of curvature, wherein the radius of curvature is greater than two inches. However, the upper section 37 of the first curved side surface 30 and the upper section 39 of the second curved side surface 31 both have a tighter radius of curvature, wherein the radius of curvature is less than one inch. The radius of curvature for the upper section 37 of the first curved side edge 30 is about double that of the radius of curvature for the upper section 39 of the second curved side edge 31. As a consequence, the upper section 37 of the first curved side edge 30 curves less than the upper section 39 of the second curved side edge 31 and terminates at a height that is higher than the height of the second side edge 31.

On the first curved side edge 30, the lower section 33 and the upper section 37 meet at a curve transition point P1. Likewise, on the second curved side edge 31, the lower section 35 and the upper section 39 meet at a curve transition point P2. The distance D1 between the first curve transition point P1 and the second curve transition point P2 is the widest part of the brake shoe housing 26, being at least five percent longer than the length L1 of the bottom edge 29.

A spring attachment slot 42 is formed in the brake shoe housing 26. The spring attachment slot 42 separates the upper section 37 of the first curved side edge 30 from the upper section 39 of the second curved side edge 31. The slot 42 has an enlarged opening 43 at its distal end. The shape of the slot 42 and its enlarged opening 43 creates a large hook projection 45.

Figure 4:
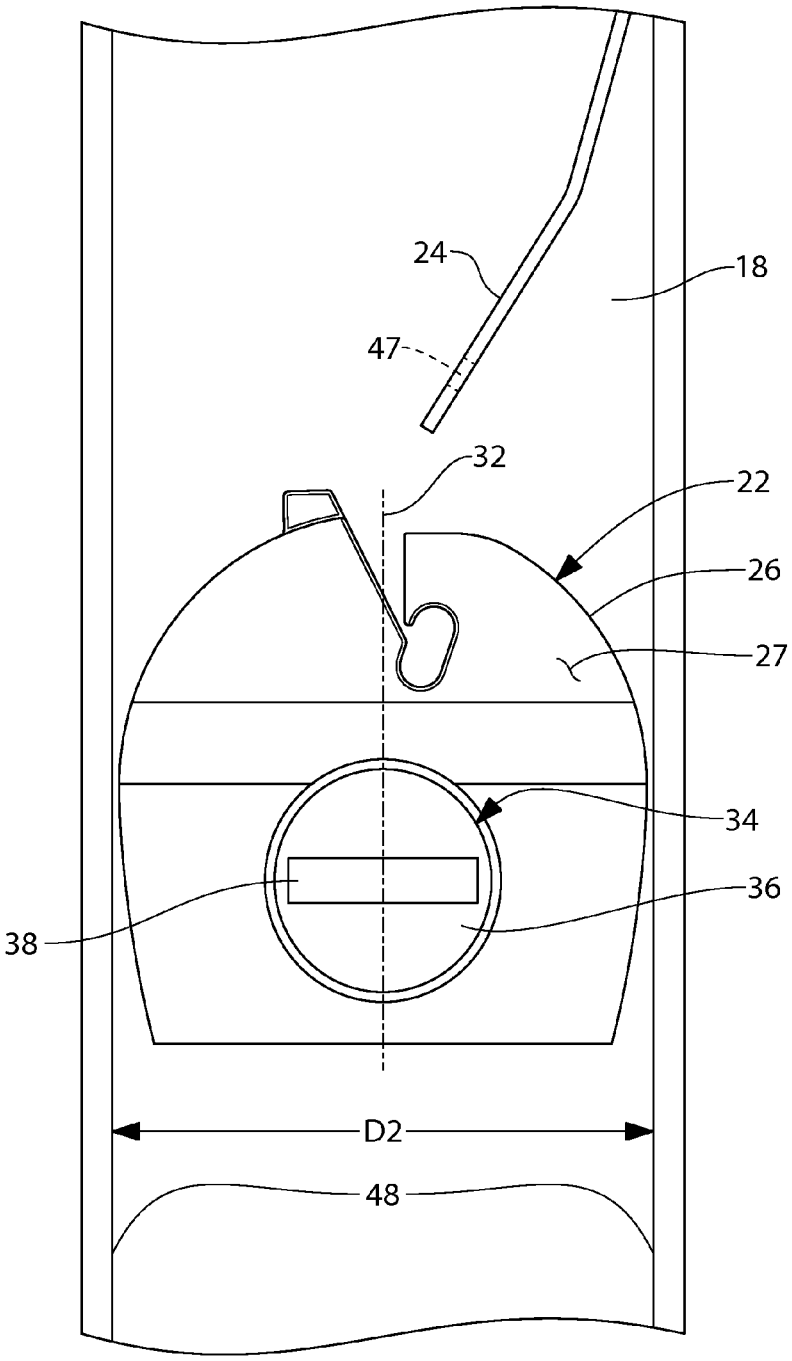
FIG. 4 is a side view of the exemplary embodiment of a brake shoe assembly shown in a guide track.

Referring to FIG. 4 in conjunction with FIG. 3, the brake shoe 22 is shown inside the guide track 18 of the window frame. The guide track 18 has two opposing vertical walls 48. The distance D2 between two opposing vertical walls 48 is only slightly greater than the distance D1 between the curve transition points P1, P2.

The curl spring 24 is attached to the brake shoe 22 within the guide track 18. The curl spring 24 is essentially a two-dimensional ribbon having a wide face surface and a very narrow side edge. The curl spring 24 is oriented so that the face surface of the curl spring 24 lay at a perpendicular to the rear wall of the guide track 18 between the two opposing vertical walls 48.

A hole 47 is formed through the curl spring 24 near its free end. When the free end of the curl spring 24 is inserted into the slot 42 on the brake shoe 22, the hook projection 45 engages the hole 47 in the curl spring 24 and prevents the curl spring 24 from being inadvertently pulled out of the slot 42. It will therefore be understood that the engagement of the hook projection 45 with the hole 47 in the curl spring 24 mechanically interconnects the brake shoe housing 26 and the curl spring 24.

The brake shoe housing 26 is shown with an imaginary centerline 32 extending down the center of the brake shoe housing 26 between the first and second curved side edges 30, 31. The imaginary centerline 32 lays perpendicular to the bottom edge 29 of the brake shoe housing 26. For the purposes of this specification, the brake shoe housing 26 is considered to be in a "straight" orientation when the imaginary centerline 32 is vertical and the bottom edge 29 is horizontal.

A brake mechanism 34 is contained within the brake shoe housing 26. The brake mechanism 34 includes a cam actuator 36. The cam actuator 36 rotates within the brake shoe housing 26, as will later be explained. A portion of the cam actuator 36 extends through an access hole in the face surface 27 of the brake shoe housing 26. A recess 38 is formed within the exposed portion of the cam actuator 36. The recess 38 receives the horizontal tilt post 21 (FIG. 2) that extends from the window sash. Consequently, when the window sash is tilted, the cam actuator 36 is caused to turn within the brake shoe housing 26.

Figure 5:
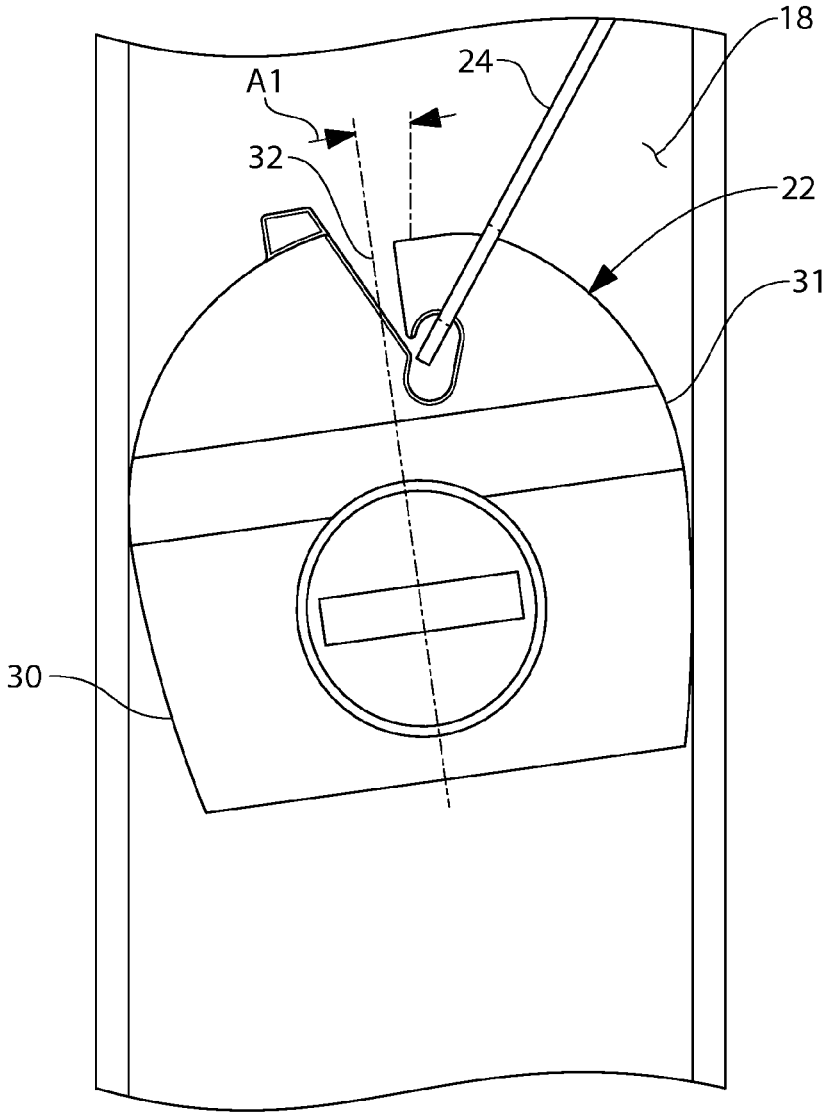
FIG. 5 is the same view as FIG. 4, with the brake shoe assembly being shown cocked by a curl spring.

Referring to FIG. 5 in conjunction with FIG. 3, it can be seen that when the brake shoe assembly 22 is placed within a guide track 18 of a window frame, the curl spring 24 applies a turning torque to the brake shoe assembly 22. The torque causes the brake shoe assembly 22 to cock slightly within the confines of the guide track 18. The brake show assembly 22 cocks in a plane that is perpendicular to the two opposing vertical walls 48 of the guide track 18. As a consequence, the imaginary centerline 32 of the brake shoe housing 26 is turned away from its initial vertical orientation by a slight displacement angle A1. The displacement angle A1 is typically only a few degrees, but may be as large as ten degrees. The displacement angle A1 at which the brake shoe assembly 22 is tilted changes slightly as the sash of a window is raised and lowered. As the sash of a window is raised and lowered, the orientation of the curl spring 24 relative to the brake shoe assembly 22 changes slightly. This results in different torque forces being applied to the brake shoe assembly 22. Thus, variations in the displacement angle A1 of the brake shoe assembly 22 occur as a window sash is raised and lowered.

As the brake shoe assembly 22 tilts within the guide track 18, the upper portion 37 of the first curved side edge 30 and the lower portion 35 of the second curved side edge 31 contact the opposing vertical walls 48 of the guide track 18. Since the side vertical walls 48 are flat, the walls 48 contact the first and second curved side edges 30, 31 at a tangent to those curved surfaces.

The tangential contact between the first and second curved side edges 30, 31 of the brake shoe housing 26 and the opposing vertical walls 48 of the guide track 18 provide very little frictional resistance to the movement of the brake shoe assembly 22 within the guide track 18. Furthermore, since the first and second curved side edges 30, 31 bend toward one another, there are no salient points on the brake shoe housing 26 that can wear into the vertical walls 48 of the guide track 18 and bind the brake shoe assembly 22. The result is a brake shoe assembly 22 that is more reliable and is less likely to bind than traditional prior art devices.

Figure 6:
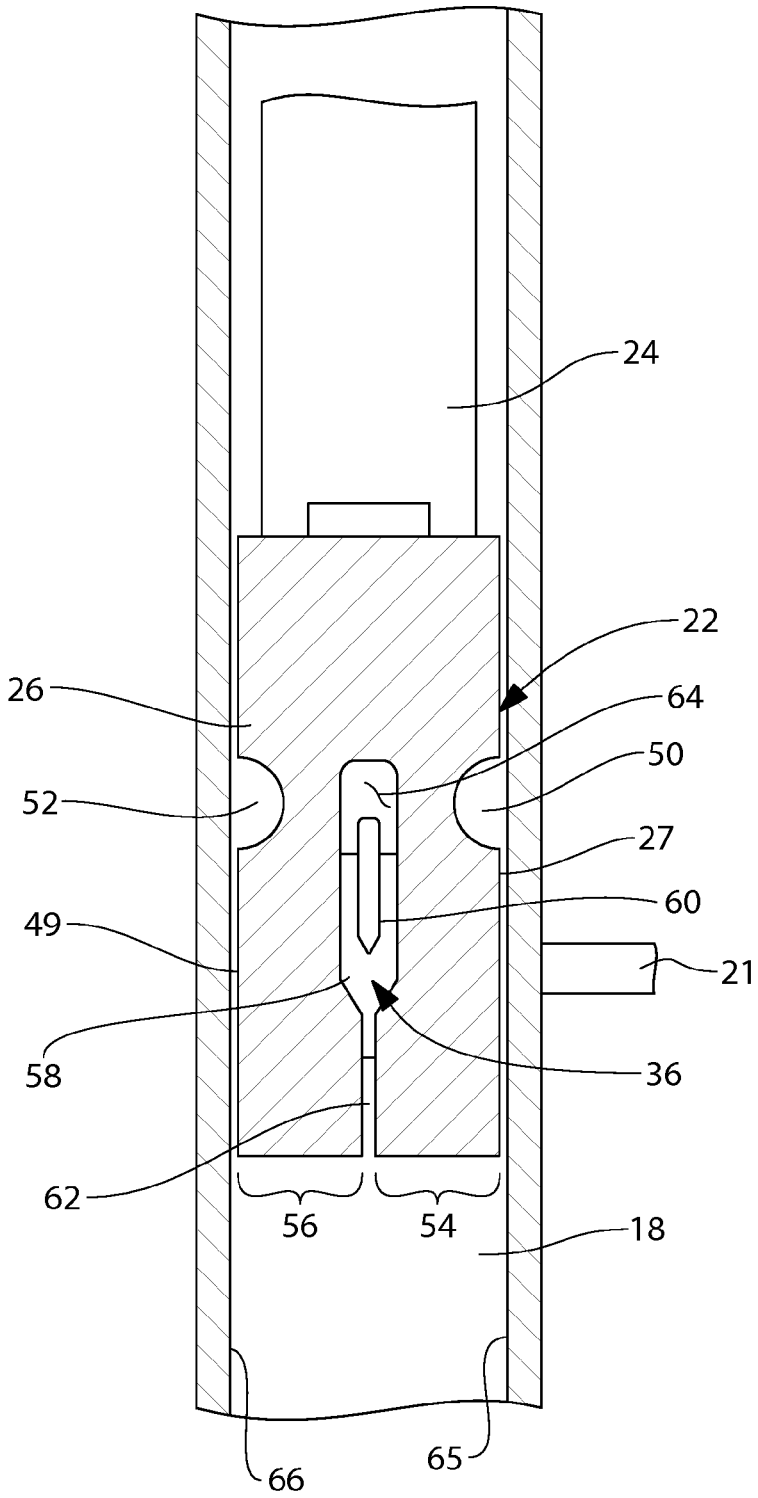
FIG. 6 is a cross-sectional view of the brake shoe assembly shown in a free position, viewed along section line 6 of FIG. 5.

Referring to FIG. 6, it can be seen that the brake shoe housing 26 has a face surface 27 and a rear surface 49. A first lateral groove 50 is formed across the face surface 27 of the brake shoe housing 26. A parallel second lateral groove 52 is formed in the rear surface 49 of the brake shoe housing 26 at a corresponding position. Above the level of the first and second lateral grooves 50, 52, the brake shoe housing 26 is mostly solid. However, below the level of the first and second lateral grooves 50, 52, the brake shoe housing 26 is divided into a separate face section 54 and rear section 56.

The first and second lateral grooves 50, 52 thin the material of the brake shoe housing 26 in the face section 54 and the rear section 56. The first and second lateral grooves 50, 52 therefore create living hinges that allow the face section 54 and the rear section 56 of the brake shoe housing 26 to be selectively spread apart by the application of a spreading force.

In FIG. 6, it can be seen that the cam actuator 36 that extends through the brake shoe housing 26 contains a cylindrical body 58. On the exterior of the cylindrical body 58 is a cam arm 60. The cam arm 60 extends across no more than half the circumference of the cylindrical body 58.

Inside the brake shoe housing 26, the face section 54 of the housing 26 and the rear section 56 of the housing 26 are separated by a severance space 62. The severance space 62 is narrow below the level of the first and second lateral grooves 50, 52. However, just above the first and second lateral grooves 50, 52 there is an enlarged area 64.

When the sash of a window is in its functional, non-tilted position, the tilt-post 21 of the window orients the cam actuator 36 so that the cam arm 60 is positioned within the enlarged area 64 of the severance space 62. Such an orientation is shown in FIG. 6. When in such an orientation, the cam arm 60 does not act to spread the face section 54 of the housing 26 from the rear section 56 of the housing 26. Rather, the enlarged area 64 is slightly wider than the cam arm 60, thus the cam arm 60 has no effect on the brake shoe housing 26.

The distance between the face surface 27 of the brake shoe assembly 22 and the rear surface 49 of the brake shoe assembly 22 is smaller than the distance in between a forward wall 65 and a rearward wall 66 of the window frame guide track 18. The brake shoe assembly 22 is therefore free to move within the window frame guide track 18 uninhibited.

Figure 7:
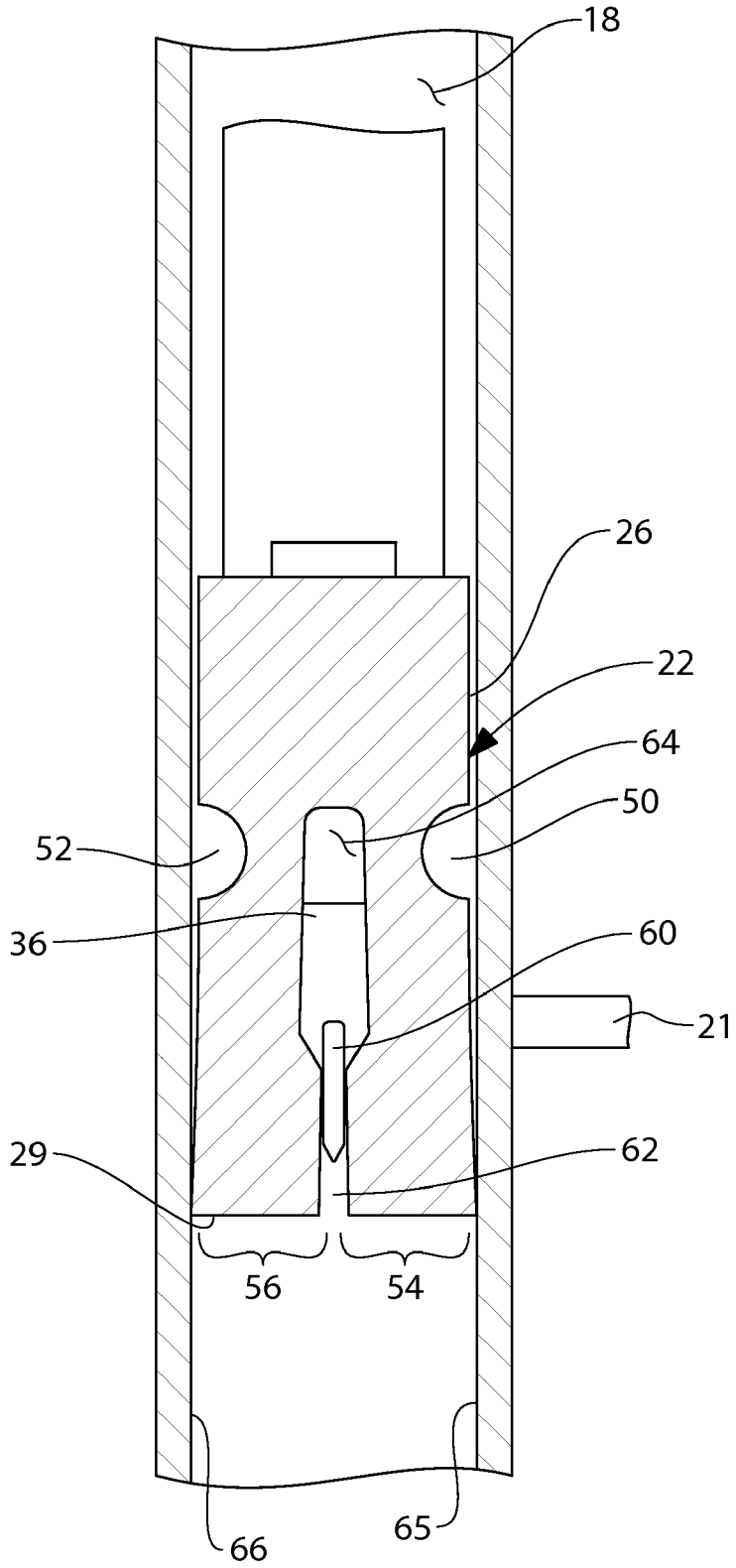
FIG. 7 is a cross-sectional view of the brake shoe assembly shown in a locked position, viewed along section line 6 of FIG. 5.

Referring now to FIG. 7, it can be seen that the tilt-post 21 from the window has rotated. This rotation occurs when the sash of the window is tilted inwardly. As the tilt-post 21 rotates, the cam actuator 36 rotates. This causes the cam arm 60 to rotate out of the enlarged area 64 of the severance space 62. As the cam arm 60 rotates out of the enlarged area 64, the cam arm 60 passes in between the face section 54 and the rear section 56 of the brake shoe housing 26. This forces the face section 54 and the rear section 56 of the brake shoe housing 26 to spread apart.

The face section 54 and the rear section 56 hinge about the first and second lateral grooves 50, 52 as they spread. As such, the distance between the face surface 54 and the rear surface 56 increases and is at its maximum proximate the bottom edge 29. As the face section 54 and the rear section 56 spread, both sections 54, 56 contact, and are biased against, the forward wall 65 and rearward wall 66 of the window frame guide track 18. This causes the brake shoe assembly 22 to bind within the window frame guide track 18 and lock into place. It will therefore be understood that once a window sash is tilted and the cam actuator 36 is caused to turn, the brake shoe housing 26 spreads and the brake shoe assembly 22 locks in place within the window frame guide track 18.

Once the window sash is rotated back to its functional position, the cam arm 60 on the cam actuator 36 rotates back to the enlarged area 64 of the severance space 62. The bias force separating the face section 54 and the rear section 56 of the brake shoe housing 26 is removed. The face section 54 and the rear section 56 then converge back toward each other until the brake shoe assembly 22 is again free to move up and down within the confines of the window frame guide track 18.

It will be understood that the embodiment of the present invention counterbalance system that is described and illustrated herein is merely exemplary and a person skilled in the art can make many variations to the embodiment shown without departing from the scope of the present invention. All such variations, modifications and alternate embodiments are intended to be included within the scope of the present invention as defined by the appended claims.

What is claimed is:

1. A method of decreasing friction in a counterbalance system for a tilt-in window, comprising:

providing guide tracks, wherein each of said guide tracks has two opposing vertical walls spaced a predetermined distance apart;

providing a window sash having tilt posts that extend outwardly therefrom, wherein said window sash is rotatable about said tilt posts between an operational orientation and a tilted orientation;

providing brake shoes within said guide tracks, said brake shoes receiving said tilt posts and guiding said tilt posts within said guide tracks, wherein each of said brake shoes has a housing having two curved side edges that include a first curved side edge and a second curved said edge, and wherein each of said brake shoes has a face surface and a rear surface disposed between said two curved side edges;

providing a cam disposed between said face section and said rear section within each of said brake shoe, wherein said cam biases said face section and said rear section apart when said sash is tilted from said operational orientation to said tilted orientation; and providing coil springs, wherein said coil springs have free ends that connects to said brake shoes said grooves, wherein said coil springs apply torque to said brake shoes to bias said first curved side edge and said second curved side edge of each of said brake shoes into tangential contact with said opposing vertical walls of said guide tracks.

2. The method according to claim 1, further including the step of providing said coil springs with holes proximate said free ends, wherein said holes are engaged by said brake shoes.

3. The method according to claim 2, wherein said brake shoes have hook shaped portion, wherein said method further includes the step of interconnecting said hook shaped portion with said holes in said free ends of said coil springs.

4. The method according to claim 1, wherein said first curved side edge of each of said brake shoes has lower section of a first radius of curvature and an upper section of a second radius of curvature, wherein said lower section and said upper section meet at a first transition point.

5. The method according to claim 4, wherein first radius of curvature is greater than said second radius of curvature.

6. The method according to claim 1, wherein said second curved side edge of each of said brake shoes has lower section of a first radius of curvature and an upper section of a second radius of curvature, wherein said lower section and said upper section meet at a second transition point.

7. The method according to claim 6, wherein each of said brake shoes has a bottom surface of a predetermined length, wherein said first curved side edge and said second curved side edge extend upwardly from opposite ends of said bottom surface.

8. The method according to claim 7, further including the step of spacing apart said first transition point and said second transition point by a distance that is greater than said predetermined length.

9. A method of decreasing friction and wear between a brake shoe and a guide track in a counter balance system for a sash of a tilt-in window, wherein said sash is rotatable between an operational orientation and a tilted orientation, said method comprising the steps of:

providing a guide track having two opposing vertical walls;

providing a brake shoe having two curved side edges that include a first curved side edge and a second curved said edge, wherein said brake shoe has a face surface and a rear surface disposed between said first curved side edge and said second curved side edge;

providing a cam disposed between said face section and said rear section within said brake shoe, wherein said cam biases said face section and said rear section apart when said sash is tilted from said operational orientation to said tilted orientation;

providing a coil spring having a free end;

positioning said brake shoe in said guide track; and connecting said free end of said coil spring to said brake shoe, wherein said coil spring applies a torque to said brake shoe biasing said first curved side edge and said second curved side edge into tangential contact with said opposing vertical walls of said guide track.

10. The method according to claim 9, wherein said step of providing a brake shoe includes providing a brake shoe having a housing that forms a hook configuration.

11. The method according to claim 10, wherein said step of providing a coil spring includes providing a coil spring having a hole formed through it proximate said free end.

12. The method according to claim 11, wherein said step of connecting said free end of said coil spring to said brake shoe includes engaging said hole in said coil spring with said hook configuration of said housing of said brake shoe.

* * * * *